US006175189B1

(12) United States Patent
Brooks

(10) Patent No.: US 6,175,189 B1
(45) Date of Patent: Jan. 16, 2001

(54) FLOATING REFERENCE FAULT PROTECTION CIRCUIT FOR ARC DISCHARGE LAMP BALLAST

(75) Inventor: Douglas William Brooks, Carson City, NV (US)

(73) Assignee: Bruce Industries, Inc., Dayton, NV (US)

( * ) Notice: Under 35 U.S.C. 154(b), the term of this patent shall be extended for 0 days.

(21) Appl. No.: 09/287,540

(22) Filed: Apr. 6, 1999

(51) Int. Cl.[7] ..... H05B 37/00
(52) U.S. Cl. ..... 315/119; 315/246
(58) Field of Search ..... 315/119, 276, 315/121, 225, 291, 246, 224, 209 R

(56) References Cited

U.S. PATENT DOCUMENTS

Re. 35,994 * 12/1998 Lestician ..... 315/291
4,210,846 * 7/1980 Capewell et al. ..... 315/121
5,173,643 * 12/1992 Sullivan et al. ..... 315/276
5,705,894 * 1/1998 Krummel ..... 315/119
5,883,473 * 3/1999 Li et al. ..... 315/225

* cited by examiner

*Primary Examiner*—Don Wong
*Assistant Examiner*—Chuc Tran D
(74) *Attorney, Agent, or Firm*—Natan Epstein; Beehler & Pavitt

(57) ABSTRACT

A fault protection circuit for fluorescent lamp ballasts cuts off ballast power to the lamp in response to fast rise-time changes but not slower changes in either current output or voltage output of the ballast. The fault protection circuit is compatible with different ballast circuit topologies and features a floating reference level which renders the circuit insensitive to the lamp load wattage, making the circuit particularly useful in so-called universal ballasts.

15 Claims, 2 Drawing Sheets

FLOATING REFERENCE FAULT PROTECTION CIRCUIT FOR ARC DISCHARGE LAMP BALLAST

BACKGROUND OF THE INVENTION

1. Field of the Invention

This invention pertains to the field of ballast circuits for powering arc discharge lamps, and is more particularly directed to a fault protection circuit for turning off ballast output power to the lamp load in the event of lamp malfunction.

2. State of the Prior Art

Arc discharge lamps such as fluorescent lamps require relatively high operating voltages, particularly when first initiating the arc discharge in the lamp. Once started, the lamp current must be externally limited to a normal level because arc lamp impedance characteristically drops after start-up. Many so called ballast circuits have been devised for supplying the necessary voltages and currents for powering such lamps.

Arc discharge lamps, for example fluorescent lamp tubes, are subject to certain types of malfunction characteristic of this type of lamp. If the lamp tube is loosened from its electrical socket the lamp connectors or pins may become sufficiently exposed to sustain an arc discharge between the exposed metal parts. Such an arc discharge is undesirable not only because it can severely stress the electrical components of the ballast circuit, but may also pose a fire and electrical shock hazard. Under such circumstances, it is, of course, desirable to shut down electrical power to the lamp immediately. Another type of lamp malfunction occurs with aging of the discharge lamp, manifested by partial rectification of the A.C. current delivered by the ballast to the lamp load. In this case too it is desirable to interrupt electrical power to the lamp load in order to call the attention of maintenance personnel to the need for replacing the lamp. Ballast output protection is particularly needed in arc discharge lamp fixtures installed in aircraft cabin lighting. Aircraft vibration may shake individual lamps loose from their sockets exposing the metal contacts and resulting in arcing. Electrical arcs are clearly undesirable in an environment exposed to combustible fumes from jet fuel.

Various schemes have been devised for sensing abnormal operating conditions of the lamp load in arc discharge fixtures and shutting down the output of the ballast in such event. For example, it is known that certain failure modes, particularly arcing, result in abnormally high transient voltages and currents through the lamp load. This knowledge has been exploited in the past to design protection circuits responsive to such higher than normal voltages or currents. In one known type of protection circuit a voltage comparator has one input connected for sensing the lamp voltage and the other input referenced to a fixed, preset voltage threshold. The output of the comparator is connected for switching off the ballast output in the event that the lamp voltage exceeds the treshhold voltage. This type of output protection circuit works well in ballasts intended for use with a known lamp load, i.e. a given lamp wattage. If the lamp wattage is known in advance, then the normal operating lamp voltage can be anticipated and a reliable reference voltage can be preset for the comparator circuit.

The conventional idea of sampling the output voltage or current of the lamp load and comparing that information against a fixed reference for sensing an over voltage or over current condition is sound. However, the use of a fixed reference will not work when the output lamp load changes, or the ballast is designed for bright and dim lamp operation. This shortcoming is particularly evident with so called universal ballasts designed to supply a range of lamp loads, allowing an end user to install lamps of different wattage as needed. Universal ballasts simplify inventories of electrical supply vendors and facilitate ballast replacement in installed light fixtures, and have come into widespread usage.

What is needed is an output protection circuit which can sense abnormal or unsafe operating conditions at the output of an arc discharge lamp ballast intended for operation with variable lamp loads. Such a protection circuit should be reliable, relatively simple and economical.

SUMMARY OF THE INVENTION

The aforementioned need is addressed by this invention which provides a floating reference fault detection circuit for arc discharge lamp ballasts useful with ballasts intended for supplying variable lamp loads. The improved fault detection circuit has a comparator with first and second inputs of opposite polarity and a comparator output, and a sampling circuit connected for deriving a sample signal related to the lamp voltage or lamp current delivered by the ballast output The sample signal is provided to both of the comparator inputs, and a biasing circuit is connected for holding one of the inputs at a bias above the sample signal relative to the other of the comparator inputs, thereby to hold the comparator output in a normal state. A discriminator circuit is connected for passing relatively fast rise-time waveforms only and not slower change sin the waveforms to the other of the comparator inputs, such that a relatively fast rise-time component waveform of sufficient amplitude in the sample signal overcomes the bias and changes the comparator output to a shut down state. The bias voltage is summed to the sample signal voltage at the comparator input and consequently provides a floating reference voltage independent of the absolute value of the voltage or current at the ballast output. As a result, abnormal fast rise-time components of sufficient amplitude of the sample signal can be reliably detected relative to the bias level irrespective of slower fluctuations and changes in lamp voltage or current, and irrespective of changes in lamp load wattage.

The sample signal may be a rectified A.C. signal derived from the voltage or current supplied at the ballast output to a lamp load. The sampling circuit may be a voltage divider, such as a resistive voltage divider, connected for sampling the alternating voltage at the ballast output and a full wave rectifier for rectifying the sampled voltage to derive the sample signal. Alternately, the sampling circuit may include a current transformer connected for sampling an alternating lamp current and a circuit for converting the sampled current to a sample voltage, which is then rectified by a full wave rectifier to derive the sample signal. The discriminator circuit may be a low pass filter, such as a low pass capacitor connected across; the comparator input to remove higher frequency components in the sample signal. The biasing circuit may be a resistive voltage divider connected for holding one of the comparator inputs at a bias voltage relative to the other comparator input. A latching diode may be connected between the comparator output and a comparator input for latching the output in the shut down state.

The bias between the comparator inputs may be fixed, but since it is added to the sample signal at the comparator inputs the bias provides a floating reference level substantially independent of the voltage or current through the lamp load.

It is contemplated that the fault protection circuit is to be part of a ballast unit, and therefore the invention contemplates the combination of the floating reference fault protection circuit with a ballast circuit intended for powering an arc discharge lamp load, to provide in combination an output protected ballast.

In a broader sense, the invention is a fault detection circuit for detecting relatively fast rise-time changes in either current or voltage output of the ballast, the fault detection circuit having an output connected for turning off electrical power from the ballast to the lamp load in response to the fast rise-time changes. The fault detection circuit includes a filter, such as a low pass capacitor, selected to pass waveforms representative of undesirable lamp conditions to an input, such as a comparator input of the fault detection circuit. One comparator input is held at a bias relative to the other comparator input, and the filter is connected such that the bias is overcome by fast rise-time changes of sufficient amplitude to derive a fault output by a change of state of the comparator output.

The invention also includes a method for protecting the output of a ballast circuit for powering a fluorescent lamp load. The novel method comprises the steps of sampling detecting relatively fast rise-time changes in current or voltage output of the ballast in excess of a predetermined amplitude and interrupting electrical power from the ballast circuit to the lamp load in response to relatively fast rise-time changes of sufficient amplitude substantially independently of the absolute value of the lamp current or lamp voltage. The sufficiency of the amplitude is predetermined by a bias level against which the fast rise-time changes are compared but not in response to slower changes or fluctuations in the current or voltage.

For greatest sensitivity to different modes of lamp failure, fast rise-time components in both lamp current and lamp voltage may be sampled against a floating bias or reference voltage, and a shut down output may be derived upon sensing either a fast over-voltage or over-current event in the sample signal against the floating reference. For example, two separate floating reference comparator circuits may be used, one comparator receiving a sampled current input and the other a sampled voltage input, and the outputs of the two comparators connected in a logic OR circuit to derive a single fault or ballast shut-down output.

The method for protecting the output of a ballast circuit for powering a fluorescent lamp load according to this invention may also be said to have the steps of deriving a sample signal related to the voltage or current across the lamp load, applying the sample signal as a first comparator input signal, deriving a second comparator input signal by filtering fast rise time waveforms from the sample signal and adding a bias level, comparing the first and second comparator input signals; and shutting off power to the lamp load if the first comparator input signal sufficiently exceeds the second comparator input signal.

These and other improvements, features and advantages will be better understood from the following detailed description of the preferred embodiments taken in conjunction with the accompanying drawings.

DETAILED DESCRIPTION OF THE PREFERRED EMBODIMENTS

Figure 1:
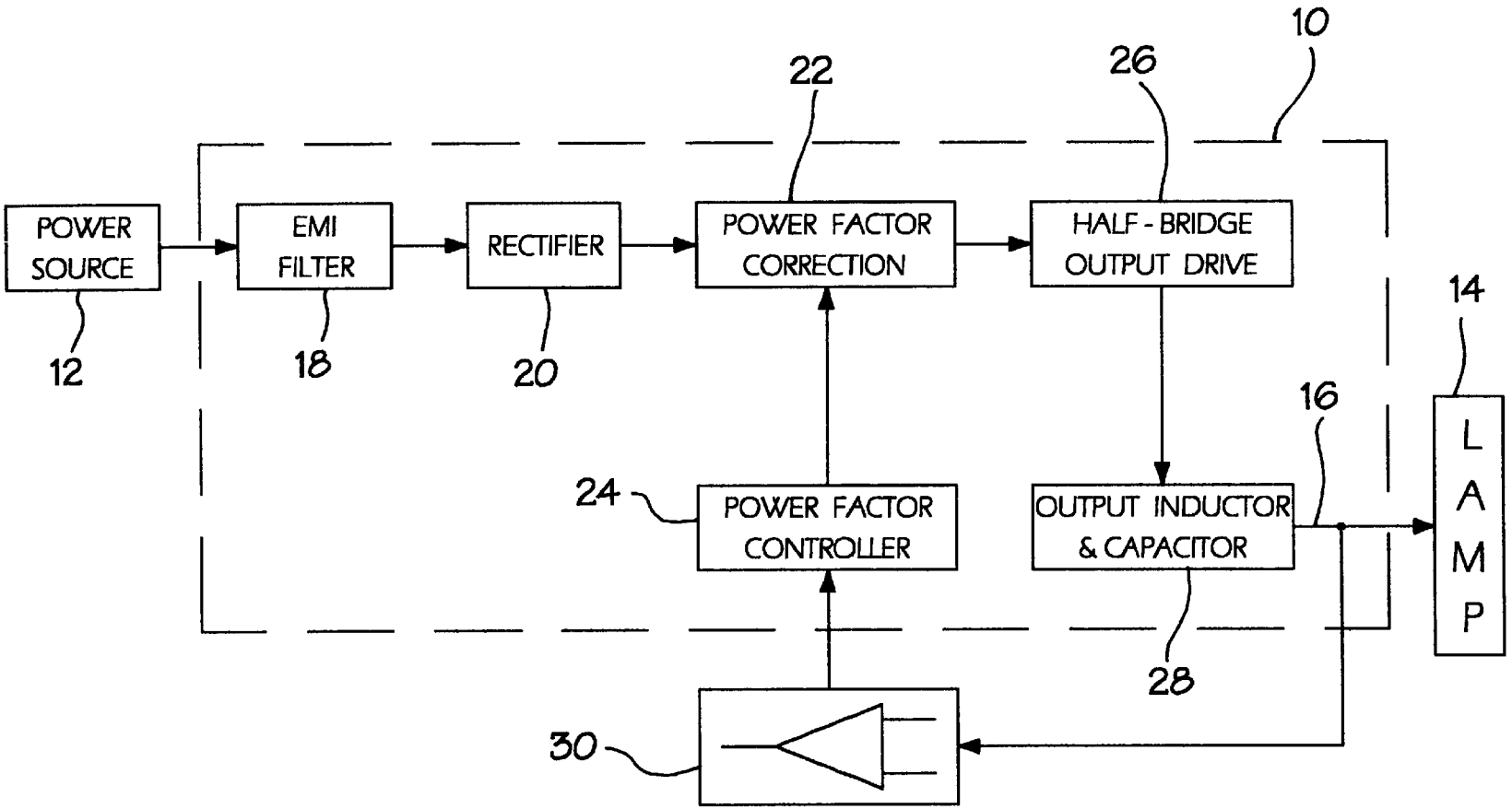
FIG. 1 is a block circuit diagram illustrating a typical electronic ballast equipped with the fault protection circuit according to this invention.

With reference to the accompanying drawings, FIG. 1 is a block diagram of a typical electronic ballast 10 supplied by a power source 12 and powering an arc discharge lamp load 14 connected to the ballast output 16. The internal operation of the electronic ballast 10 need not be described in detail inasmuch as such units are known and understood. In general, the ballast circuit receives low voltage low frequency AC electrical power from power source 12 through an electromagnetic interference filter 18. The AC power is converted to DC power by rectifier 20, regulated by a high frequency power factor correction circuit 22 which cooperates with power factor controller 24. High frequency AC power is delivered to the lamp load by a half-bridge output drive 26 through an output inductor/capacitor 28. In effect, the ballast circuit delivers high frequency high voltage power to the arc discharge lamp load, makes a power factor correction to minimize adverse impact on the quality of the AC power delivered to other systems also supplied by power source 12, and by means of EMI filter 18 keeps spurious signals generated by the ballast circuit from passing back to the power source and possibly interfering with operation of other devices. The power delivered to the lamp load at the ballast output 16 is typically high frequency A.C. such as 25 kHz.

Figure 2:
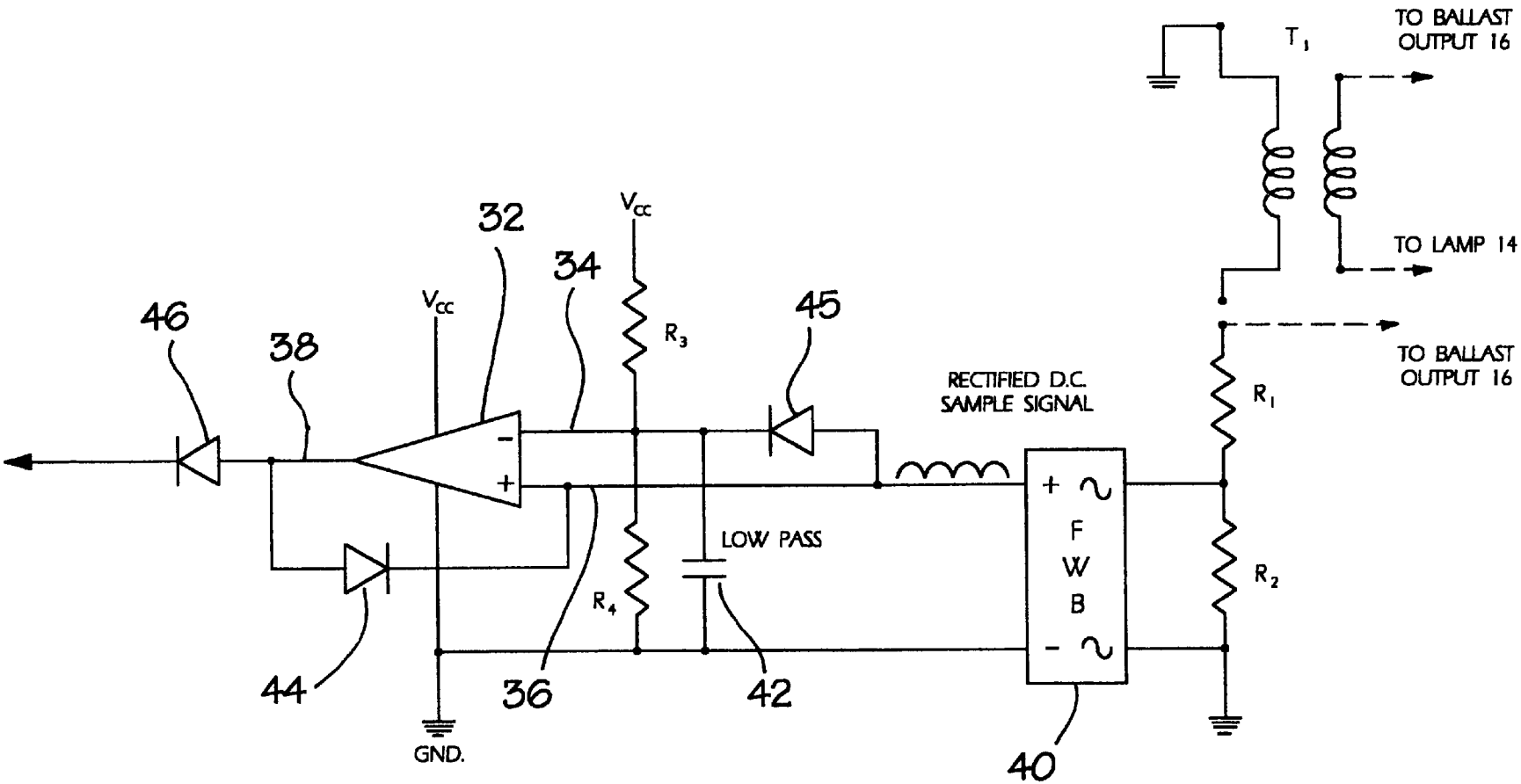
FIG. 2 is a more detailed circuit diagram of the ballast output fault protection circuit.

The present invention improves upon the ballast circuit 10 by providing a floating reference fault detection circuit generally designated by numeral 30 in FIG. 1 and shown in greater detail in FIG. 2. Turning now to FIG. 2, the fault detection circuit 30 includes a voltage comparator 32 which has a positive input 34, a negative input 36, and a comparator output 38. The comparator is connected to a suitable voltage supply $V_{cc}$ and a circuit ground Gnd. A resistive voltage divider comprised of resistors R1, R2 is connected across the output 16 of the ballast 10, i.e. across the lamp load 14. The relative values of resistors R1, R2 are such as to derive a lower voltage A.C. sample signal usable as an input to the fault protection circuit The R1, R2 voltage divider may be connected across the ballast output, i.e. across the lamp load 14. This sample signal input is rectified by full wave rectifier 40 to produce a high frequency single polarity rippling D.C. sample signal. The D.C. ripple output of the rectifier is connected to both the positive and negative inputs of the comparator. The positive comparator input receives the unfiltered output of rectifier 40. The negative comparator input, however, receives the rectified sample signal filtered by low pass capacitor 42. As a result, higher frequency components of the rectified sample signal are filtered out and removed before reaching the negative input of the comparator. These high frequency components do however, reach the positive input of the comparator.

A biasing circuit includes a resistive divider R3, R4 connected to keep the negative input of comparator 32 at a bias voltage above the positive input. The bias voltage applied to the negative input is added to and floats on the filtered DC sample signal delivered by rectifier 40. As a result, in a normal condition of the circuit 30, i.e. in the absence of high frequency components of the sample signal, the negative input is at all times biased above the positive input and holds the comparator output 38 in a normal state. Diode 45 isolates the positive and negative comparator inputs from each other to maintain the bias level.

Upon occurrence of a lamp malfunction of the type mentioned earlier, resulting in higher voltage fast rise-time transients, these fast rise components are also rectified with the sample signal. The positive input receives the sample signal including the unfiltered and unmodified high voltage transients. The fast rise-time transients, however, are filtered out by the low pass capacitor 42 before reaching the negative input of the comparator, so that the negative input 34 receives the sample signal minus its higher frequency components. This condition upsets the voltage relationship between the two comparator inputs because the positive input voltage is raised to the extent of the transients filtered from the negative input As a result, a fast rise transient of sufficient amplitude, i.e. of amplitude exceeding the bias level of the negative input 34, raises the voltage at the positive input 36 sufficiently to overcome the bias and causes the comparator output to change to a fault output. A latching diode 44 is connected between output 38 and the positive input 36 so as to latch and hold the comparator 32 in a fault state. As a result, the two possible states of the voltage comparator provide an indication of a normal operating condition of the lamp load or an abnormal, fault condition of the lamp load. These two states of the comparator output 38 are then used so as to turn off the output of the ballast 10 in the event of a fault condition. Ballast output may be turned off by any convenient means depending on the topology of the particular ballast circuit. In the case, of an electronic ballast with a power factor controller, the controller integrated circuit typically used for this purpose includes a control input which can be brought high or low to turn the ballast output on or off. If such a control input is unavailable, ballast output may be turned off by, for example, driving low the base of a suitably chosen output drive transistor. The precise manner in which the ballast output is controlled by the comparator output may be left to the designer of a given ballast system. It will be appreciated that the fault detection circuit 30 can be adapted for use with a wide range of arc discharge lamp ballasts of different topologies.

In an alternate form of the invention, the fault detection circuit 30 derives the sample input from ballast output current i.e. from the lamp current flowing through the lamp load 14, rather than from the lamp voltage supplied by the ballast output 16. In that case, a current transformer indicated as T1 in FIG. 2 is used to sample the lamp current, and current sample is then applied to a suitable resistive divider, such as R1, R2, to convert the current sample to a voltage sample which is then processed as described earlier in connection with FIG. 2. For current sampling the primary winding of T1 may be connected to the ballast output 16 in series with the lamp load.

It has been found that different modes of lamp failure affect lamp voltage and lamp current differently. Some types of failure, for example, an intermittent connection between the lamp and its socket in the fixture may be detected by sensing the presence of voltage transients. On the other hand, immersion of the lamp in water seems better sensed by sampling transients in lamp current For this reason, and for optimum sensitivity to different forms of lamp failure, two fault detection circuits 30, one configured for sampling lamp current, the other configured for sampling lamp voltage are used and the comparator outputs 38 of the two circuits are connected in a logical OR configuration so as to derive a fault output in the eve nt of a change in either comparator output 38, i.e. resulting from a sufficient transient in either voltage or current. In this OR configuration, an isolation diode 46 is connected in series with the output of each comparator in order to isolate the two fault detection circuits 30 from each other.

From the foregoing, it will be appreciated that the improved fault detection circuit relies upon the relatively fast rise-time of certain voltage o r current components sensed at the ballast output as a result of a faulty operating condition of the lamp load. The fast rise-time characteristic of these components is exploited in order to maintain a floating reference or bias at the comparator inputs 34, 36 which is largely independent from the absolute values of the normal operating lamp voltage or lamp current. During normal lamp operation, the lamp voltage and lamp current may fluctuate for various reasons, but such normal fluctuations are relatively slow. The value of low pass capacitor 42 is chosen so as to discriminate between the faster rise-time of the fault indicative transients and the slower normal fluctuations in the sample signal delivered to the comparator inputs.

Triggering of the comparator to a fault or shut-off output in circuit 30 therefore requires two conditions: a transient of sufficiently fast rise-time to be filtered by low pass capacitor 42, and of sufficient amplitude to overcome the relative bias between the two comparator inputs. To some extent, these two requirements are interdependent since the extent of filtering by low pass capacitor 42 is a function of the rise-time of the transient, so that slower rise-time transients will be less diminished in amplitude by the capacitor 42, and thus, the circuit will be somewhat less sensitive to slower transients because a smaller voltage difference will be induced between the two inputs by such transients. Very fast transients, on the other hand, may be entirely filtered out by capacitor 42, inducing a greater voltage difference between the inputs 34, 36. Consequently, faster transients will trigger tie fault output of the comparator at a smaller transient voltage than a slower transient.

While a particular embodiment of the invention has been described and illustrated for purposes of clarity and example, it must be understood that many changes, substitutions and modifications to the described embodiments will be apparent to those having no more than ordinary skill in the art without thereby departing from the invention as defined in the following claims.

What is claimed is:

1. An output protected fluorescent lamp ballast, comprising:

a ballast circuit for supplying electrical power to a fluorescent lamp load, and a fault detection circuit for discriminating between relatively fast rise-time changes and slower changes in either current output or voltage output of said ballast circuit to the fluorescent lamp load, said fault detection circuit having a control output connected for turning off said electrical power to the fluorescent lamp load responsive to said fast rise-lime changes but unresponsive to said slower changes in either of said current output or voltage output.

2. The ballast of claim 1 wherein said fault detection circuit comprises a comparator and a filter circuit for passing said fast-rise time changes to one comparator input but not to another comparator input of said fault detection circuit.

3. The ballast of claim 2 one said comparator input being held at a bias relative to the other comparator input, said filter being connected such that said bias is overcome by said fast rise-time changes of sufficient amplitude whereby said control output is derived by a change of state of said comparator between a normal output and a fault output.

4. The ballast of claim 3 wherein said filter is a low pass filter.

5. The ballast of claim 3 wherein said bias is summed to a sample signal derived from the voltage output or current output of said ballast such that said bias provides a floating reference substantially independent of said voltage or current output.

6. A fault protection circuit for ballasts of the type used for powering a discharge lamp load, comprising:

a comparator having first and second inputs of opposite polarity and a comparator output, sampling means connected for deriving a sample signal related to the voltage or current across the lamp load, said sample signal being connected to both said first and second inputs, biasing means for holding one of said inputs at a bias above said sample signal relative to the other of said inputs thereby to normally hold said comparator output in a normal state, and discriminator means connected for passing only relatively fast rise-time waveforms only to the other of said inputs, such that a relatively fast rise-time waveform of sufficient amplitude in said sample signal overcomes said bias thereby to change said comparator output to a shut down state independently of the absolute value of the voltage or current across the lamp.

7. The circuit of claim 6 further comprising a latching diode connected between said comparator output and one of said inputs for latching said comparator output in said shut down state.

8. The circuit of claim 6 wherein said sample signal is a rectified A.C. signal derived from a lamp voltage or a lamp current.

9. The circuit of claim 6 wherein said sampling means comprise a voltage divider connected for sampling an alternating lamp voltage and a full wave rectifier for rectifying the sampled voltage to derive said sample signal.

10. The circuit of claim 6 wherein said sampling means comprise a current transformer connected for sampling an alternating lamp current, means for converting the sampled current to a sampled voltage and a full wave rectifier for rectifying the sampled voltage to derive said sample signal.

11. The circuit of claim 6 wherein said discriminator means comprises a low pass capacitor.

12. The circuit of claim 6 wherein said biasing means comprises voltage divider resistances connected for holding said one of said inputs at a bias voltage relative to the other of said inputs.

13. A method for protecting the output of a ballast circuit for powering a fluorescent lamp load, comprising the steps of:

sampling either or both of current and voltage across the lamp load, discriminating between relatively fast rise-time changes and slower changes in current or voltage across the lamp, detecting fast rise time changes in excess of a predetermined amplitude and interrupting electrical power from the ballast circuit to the lamp in response to said relatively fast rise-time changes in either or both of said current and voltage across the lamp load in excess of said predetermined amplitude independently of the absolute value of the said current or voltage, but not in response to said slower changes in current or voltage.

14. The method of claim 13 wherein said step of detecting comprises the step of comparing the amplitude of said relatively fast rise-time changes against a bias, said bias floating on a sample signal representative of said current or said voltage across the lamp.

15. A method for protecting the output of a ballast circuit for powering a fluorescent lamp load, comprising the steps of:

deriving a sample signal related to the voltage or current across the lamp load; applying said sample signal as a first comparator input signal;

deriving a second comparator input signal by filtering fast rise time waveforms from said sample signal and adding a bias level;

comparing the first and second comparator input signals; and shutting off power to said lamp load if said first comparator input signal exceeds said second comparator input signal.

* * * * *